US005549465A

United States Patent [19]

Varadan

[11] Patent Number: 5,549,465

[45] Date of Patent: Aug. 27, 1996

[54] DRIVE ARRANGEMENT FOR PROGRESSING CAVITY PUMP

[76] Inventor: Rajan Varadan, 6406 Wigwam Dr., Orangevale, Calif. 95662

[21] Appl. No.: 522,461

[22] Filed: Aug. 31, 1995

Related U.S. Application Data

[62] Division of Ser. No. 367,783, Oct. 29, 1994, abandoned.

[51] Int. Cl.[6] ..... F04C 2/107

[52] U.S. Cl. ..... 418/48; 418/182

[58] Field of Search ..... 418/48, 182

[56] References Cited

U.S. PATENT DOCUMENTS

| | | | |
|---|---|---|---|
| 1,892,217 | 12/1932 | Moineau | 418/48 |
| 4,140,444 | 2/1979 | Allen | 418/48 |

FOREIGN PATENT DOCUMENTS

| | | | |
|---|---|---|---|
| 1476196 | 4/1989 | Russian Federation | 418/48 |
| 85331 | 1/1936 | Sweden | 418/48 |

*Primary Examiner*—John J. Vrablik

*Attorney, Agent, or Firm*—John P. O'Banion

[57] ABSTRACT

A progressing cavity pump having a rotor with a longitudinal bore and including at least one helix is mounted eccentrically within a stator having at least two helices. In a first embodiment the rotor is driven by an eccentric drive shaft which shams a journal surface with the rotor bore along the entire length of the rotor. In the second and third embodiments, the rotor is driven by a drive shaft concentric with the stator which drives a drive block having a bore that is eccentric relative to the stator. A rotor hub is rotatably mounted within the drive block bore. The drive shaft additionally drives a longitudinal auxiliary shaft within the longitudinal bore of the rotor. The auxiliary shaft is fixedly coupled to a second drive block which drives the rotor head. As external rotational actuation is applied to the drive shaft, the drive block rotates, acting as a crank on the rotor hub to drive the rotor. Simultaneously, the drive shaft actuates the longitudinal auxiliary shaft which drives the second drive block, the second drive block then acting as a crank on the head of the rotor. A fluid inlet and outlet are included with the stator, and as the rotor rotates and orbits within the stator, fluid contained in cavities between the rotor and stator helices is progressively pumped.

13 Claims, 12 Drawing Sheets

DRIVE ARRANGEMENT FOR PROGRESSING CAVITY PUMP

CROSS-REFERENCE TO RELATED APPLICATIONS

This is a divisional of application Ser. No. 08/367,783 filed on Oct. 29, 1994, abandoned.

BACKGROUND OF THE INVENTION

1. Field of the Invention

This invention pertains generally to progressing cavity positive displacement pumps, and more particularly to drive arrangements for progressing cavity pumps which have internalized speed reducing means.

2. Description of the Background Art

Progressing cavity or helical pumps are used for positive displacement of fluids. These pumps are widely used in commercial and industrial settings, frequently for submersible pumping applications. Progressing cavity pumps typically involve a rotor of helical contour that rotates within a matching stator. The rotor generally has one or more helices or lobes, while the stator has matching helices, with the stator having one more helix than the rotor, so that the ratio of rotor helices to stator helices is n/n+1. Cross sectional profiles of the rotor and stator of progressing cavity pumps are typically hypocycloidal, although involute or other profiles are feasible.

In progressing cavity pumps, the pump rotor centerline is eccentrically disposed relative to the centerline of the stator, typically by one unit of eccentricity. In operation, the rotor is rotated by external actuating means about its own centerline within the stator. As the rotor rotates, it also orbits about the centerline of the stator. If rotor rotation is clockwise, then its orbital motion within the stator is in a counterclockwise direction, and vice versa. The ratio of orbital rotation to axial rotation depends on the number of helices in the rotor and stator. The helices of the rotor and stator are shaped so that pockets of fluid are formed within the pump. The fluid pockets are moved (positively displaced) as the rotor rotates and orbits within the stator.

Since the rotor centerline is eccentric relative to the stator centerline and the rotor undergoes axial and orbital rotation movement at the same time, the rotor ends describe a nutating motion relative to the stator and pump housing. Because of this nutating motion of the rotor ends, however, the rotor cannot be directly actuated by an external drive shaft. Therefore, various drive arrangements and methods for cavity pumps have been devised to accommodate the nutating motion of the rotor. One common drive arrangement used to overcome this difficulty employs universal joints to provide power to the rotor. Other approaches have involved use of connecting rods with either pin joints or gear joints to simulate universal joints. Another method is use of a splined eccentric shaft together with allowing the stator to rotate about its own axis. Yet another approach has been to employ a flexible shaft rather than attach the shaft to universal joints.

For example, U.S. Pat. No. 4,482,305 discloses an axial flow apparatus with rotating helical chamber and spindle members which use a gear arrangement. U.S. Pat. No. 4,273,521 discloses a drive arrangement wherein gears are used to avoid the need for a universal joint. U.S. Pat. No. 4,237,704 discloses an Oldham type coupling and pump embodying the same. U.S. Pat. No. 3,982,858 discloses a segmented stator for a progressive cavity transducer employing multiple segmented stator elements connected in series, together with a universal joint. U.S. Pat. No. 3,938,915 discloses a screw rotor machine with a hollow thread rotor enclosing a screw cam rotor in which a pump has a shaft which is eccentric relative to the centerline of the rotor. U.S. Pat. No. 3,307,486 discloses a universal joint and sealing means for screw pumps, employing a universal joint. U.S. Pat. No. 2,545,604 discloses a pump using a floating drive link. Australian Patent No. 2,545,604 discloses a rotor having eccentrically placed journals on each end of the stator member. German Patent No. 2,645,933 discloses an eccentric helical rotor type positive displacement pump employing universal linkings.

As can be seen therefore, a variety of drive arrangements have been devised for use with progressing cavity or helical pumps. However, several deficiencies have become apparent in the currently known drive arrangements. Since a large number of moving parts are required for these drive arrangements, substantial space, typically in the form of an external gearbox, must be committed to the drive arrangement, thus increasing the overall size of the pump systems. Particularly, the connecting rods associated with universal joints can substantially increase the overall length of the pump. Additionally, the large number of moving parts experience wear and eventually fail, resulting in mechanical problems which increase with the complexity and number of parts in the drive arrangement. Contaminants present in the fluids transported by progressing cavity pumps tend to work into the gears and joints of the pump drive systems, further accelerating wear and failure of parts.

Yet another drawback in the background art involves electric motors used to drive submersible progressive cavity pumps. These electric motors commonly deliver high rotation speeds, generally around 3600 RPM for small electric motors. Since submersible progressive cavity pumps generally operate at substantially lower rates of rotation, external means for rotational speed reduction must be included with the pumps, generally in the form of an external gearbox.

Therefore, there is a need for a drive arrangement for progressive cavity pumps which is simple and compact, experiences reduced wear and failure, and which does not require an external gearbox to reduce the rotational speed delivered to the pump. The present invention satisfies these needs, as well as others, and overcomes the deficiencies found in prior drive arrangements.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patent teach or render obvious, singly or when considered in combination, applicant's claimed invention.

SUMMARY OF THE INVENTION

The present invention pertains to a drive arrangement for progressing cavity pumps which is simple, provides for reduced size and reduced amounts of wear, and eliminates the need for an external speed reduction gearbox.

In general terms, the invention comprises a progressing cavity pump which includes a rotor with a longitudinal bore which is mounted eccentrically within a stator, and means for rotationally driving the rotor. In a first embodiment of the invention, the rotor driving means is included along the entire length of the rotor. In a second embodiment, the rotor has a hub and a head, with the rotor hub rotatably mounted in the pump and the rotor head moving freely within the pump, and the rotor driving means is associated with the rotor hub and rotor head. In a third embodiment, both the rotor head and hub are rotatably mounted within the pump, and the rotor driving means is associated with both the rotor hub and the rotor head.

By way of example and not of limitation, the means for driving the rotor in the first embodiment is an eccentric drive shaft which shares a journal surface with the rotor bore along the entire length of the rotor. In the second and third embodiments, the means for driving the rotor is a drive shaft concentric with the stator which drives a drive block having a bore that is eccentric relative to the stator. The hub of the rotor is rotatably mounted within the drive block bore. The drive shaft additionally drives a longitudinal auxiliary shaft within the longitudinal bore of the rotor. The auxiliary shaft is fixedly coupled to a second drive block which drives the rotor head. As external rotational actuation is applied to the drive shaft, the drive block rotates, acting as a crank on the rotor hub to drive the rotor. Simultaneously, the drive shaft actuates the longitudinal auxiliary shaft which drives the second drive block, the second drive block then acting as a crank on the head of the rotor. Thus, equivalent cranks drive the rotor at both the rotor hub and rotor head. Inlet and discharge means for fluids are included with the stator and, as the rotor rotates and orbits within the stator, fluid is driven from the inlet means to the discharge means.

The drive arrangement which comprises the present invention can also be used as rotational speed reduction means for progressing cavity pumps. The invention generally has a ratio of rotor helices to stator helices of n/n+1, so that for each clockwise rotation of an external drive source, the rotor makes 1/n counterclockwise rotations within the stator. The rotor, having thus undergone a rotational speed reduction of n:1 relative to its drive source, can in turn be used to drive another rotor in a progressing cavity pump at the lower speed. This eliminates the need for external speed reduction means, which commonly must be employed with submersible pumps operated by electric motors. By varying the number of helices n, a variety of speed reduction ratios are achievable.

An object of the invention is to provide a drive arrangement for progressing cavity pumps which does not require universal joints and connecting rods for actuation of the rotor.

Another object of the invention is to provide a drive arrangement for progressing cavity pumps which is simple and contains few moving parts.

Another object of the invention is to provide a drive arrangement for progressing cavity pumps which is reduced in size.

Another object of the invention is to provide a drive arrangement for progressing cavity pumps which can be used as a speed reducer.

Another object of the invention is to provide a drive arrangement for progressive cavity pumps in which frictionally related surfaces are protected from fluid born contaminants.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings, which are for illustrative purposes only, where like reference numerals denote like parts.

DETAILED DESCRIPTION OF THE PREFERRED EMBODIMENTS

Referring more specifically to the drawings, for illustrative purposes the present invention is embodied in the apparatus which is generally shown in FIG. 1 through FIG. 11. It will be appreciated that the apparatus may vary as to configuration and as to details of the parts without departing from the basic concepts as disclosed herein.

Figure 1:
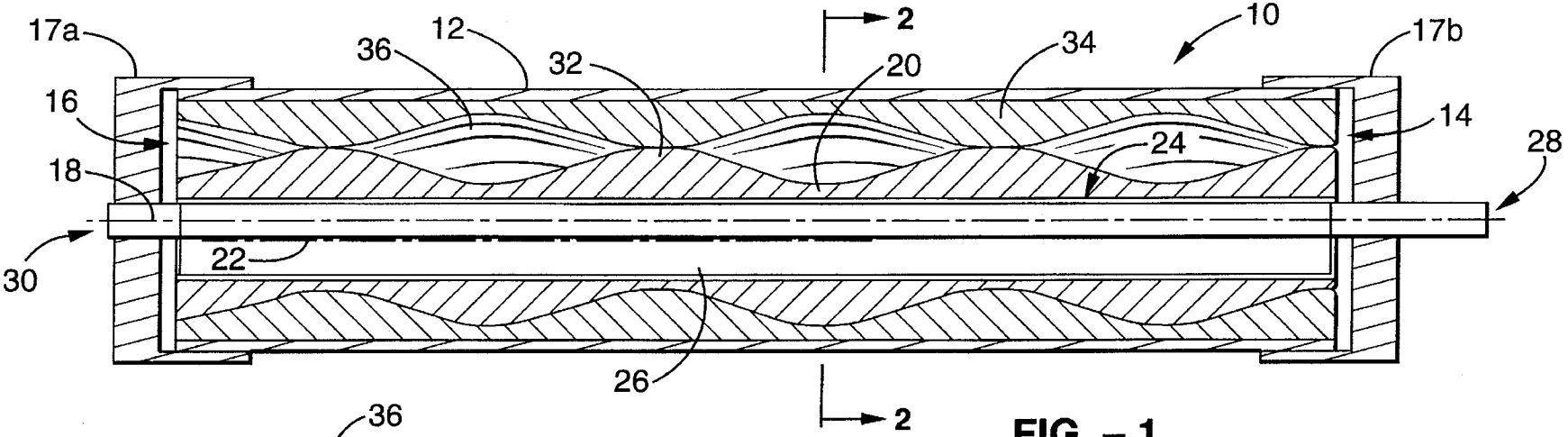
FIG. 1 is a longitudinal sectional view of a first embodiment of the present invention which exemplifies the general design and operation of the present invention.
Figure 2:
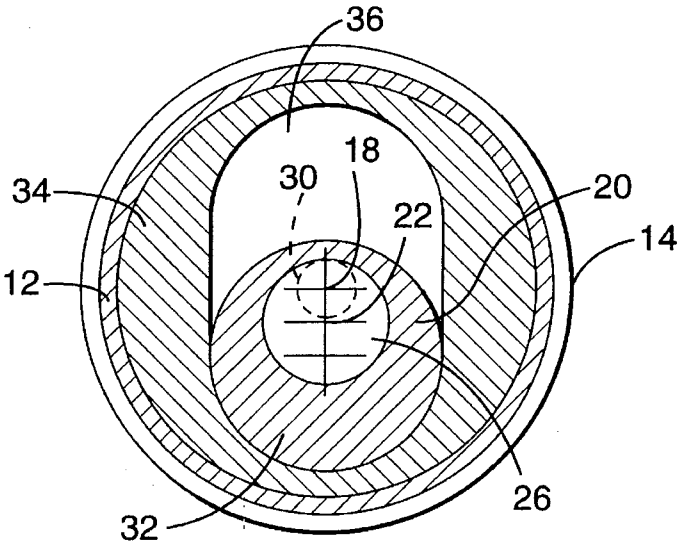
FIG. 2 is a cross-sectional view of the embodiment of the invention shown in FIG. 1 taken through line 2—2.

Referring first to FIG. 1 and FIG. 2, the general design and principle of operation of the present invention 10 is illustrated. A stator 12, having first and second ends 14, 16, and centerline 18, has a rotor 20 mounted therewithin. Rotor 20 has a centerline 22 which is eccentric relative to stator centerline 18. Rotor 20 contains a longitudinal bore 24, which accommodates means for rotatably driving the rotor. As shown in FIG. 1 and FIG. 2, the means for driving the rotor is an eccentric shaft 26 having first and second ends, 28, 30. Eccentric shaft first and second ends 28, 30 have journal surfaces with stator first and second ends 14, 16 through end caps 17*a*, 17*b* so that eccentric shaft 26 rotates within stator 12. Eccentric shaft first and second ends 28, 30 are mounted concentrically relative to stator centerline 18, while the centerline 22 of eccentric shaft 26 itself is eccentric relative to stator centerline 18. Eccentric shaft 26 has a longitudinal journal surface with rotor 20 along longitudinal bore 24. The means for driving rotor 20 may also comprise a shaft which is generally concentric with stator 12, but includes eccentric portions which share journal surfaces with longitudinal bore 24 in rotor 20. For example, eccentric portions could be included adjacent to stator first and second ends 14, 16, rather than along the entire length of bore 24, as shown in FIG. 1.

Preferably, rotor 20 includes a single helix or lobe 32, and stator 12 includes two helices 34, as shown in FIG. 2.

Helices 32, 34 are structured and configured so that a plurality of cavities 36 are formed between rotor 20 and stator 12. Preferably, friction reducing means, such as bearings and lubricants (not shown), are employed at frictionally related journal surfaces.

In operation, rotational actuation from an external power source is applied to eccentric shaft 26 at first or second ends 28, 30, or both ends, causing eccentric shaft 26 to rotate. While first and second shaft ends 28, 30 rotate concentrically relative to stator centerline 18, the bulk of eccentric shaft 26 rotates eccentrically relative to stator centerline 18. When eccentric shaft 26 is rotated, the eccentricity or "crank" of the shaft 26 "drags" rotor 20 into rotation. If eccentric shaft 26 is rotated in a counterclockwise direction, rotor 20 rotates about its own centerline 22 in a clockwise direction, and orbits about stator centerline 18 in a counterclockwise direction. The rotational and orbital motion of rotor 20 inside stator 12 cause the cavities 36 between rotor helices 32 and stator helices 34 to progressively move. When cavities 36 are filled with liquid, a pumping action is achieved. Preferably, stator helices 34 are fabricated from an elastomeric material so that a tight seal can be formed between rotor helix 32 and stator helices 34, thus preventing fluid from leaking between cavities 36 while pumping action is occurring. The embodiment of the present invention shown in FIG. 1 and FIG. 2 requires only the inclusion of fluid inlet means and fluid outlet means (not shown) in order to work as a pump. Preferably, fluid inlet means in the form of an inlet flange, inlet hose, pipe, tubing, channel or like means are included at stator first or second end 14, 16. Likewise, fluid outlet means, also preferably in the form of an inlet flange, inlet hose, pipe, tubing, channel or like means are included on the end of stator 12 opposite to the fluid inlet means.

Thus, direct rotation of eccentric shaft 26 drives rotor 20 and imparts rotational and orbital motion to rotor 20 without use of universal joints and connecting rods. Moreover, the driving of rotor 20 by eccentric shaft 26 occurs completely internally, thus eliminating the extra space associated with external drive arrangements involving universal joints and connecting rods.

As shown in FIG. 2, rotor 20 has one helix 32, and stator has two helices 34. Other helical arrangements wherein the rotor has two helices and the stator has three helices, or the rotor has three helices and the stator has four helices, or the rotor has generally n helices and the stator has n+1 helices, are also contemplated. As shown in FIG. 2, rotor and stator helices are of a generally hypocycloidal profile. Other helix profiles, such as involute, are also contemplated for use with the present invention.

Referring next to FIG. 3A, FIG. 3B, FIG. 4, and FIG. 5, a second embodiment 38 of the present invention is illustrated, where like parts are denoted by like reference numerals. In this embodiment, the means for driving the rotor preferably includes a drive shaft 40, rotatably mounted within a bearing housing 42. Fluid inlet means, shown here as an inlet housing 44, is included adjacent first end 14 of stator 12, with inlet housing 44 attached to bearing housing 42, preferably by bolts 46. Means for reducing friction, preferably in the form of a plurality of radial and thrust bearings 48, are disposed between drive shaft 40 and bearing housing 42. Bearings 48 are held in position between drive shaft shoulder 50 and collar 52. Collar 52 is attached to drive shaft 40 preferably by a set screw 54. Means for sealing out contaminants, shown here as seals 56, protect bearings 48 from contaminants and contain lubricants for the bearings. Drive shaft first end 58 includes means for attaching to an external actuation source, preferably in the form of a key or spline 60, whereby torque is transmitted to drive shaft 40 from the external source. Drive shaft 40 passes through a stuffing box 62 which contains a plurality of packings 64. Stuffing box 62 is preferably an integral portion of bearing housing 42, although it may be a separate component. The packings 64 are held in compression by a packing gland 66 which is preferably held in place by bolts (not shown).

The means for driving the rotor preferably includes, at drive shaft second end 68, a flange 70 which is attached to a hub drive block 72, preferably by bolts 74. Hub drive block 72 is mounted concentrically to drive shaft 40. Drive block 72 is rotatably mounted within a cylindrical housing flange 76, the housing flange 76 being fixedly coupled to inlet housing 44 by suitable means (not shown). Friction reducing means, preferably in the form of a marine bearing 78, is positioned between housing flange 76 and drive block 72. Hub drive block 72 includes a bore 80 that is concentric relative to rotor centerline 22 and eccentric relative to drive shaft 40 and stator center 18, so that bore 80 is located off-center relative to hub drive block 72.

Figure 3A:
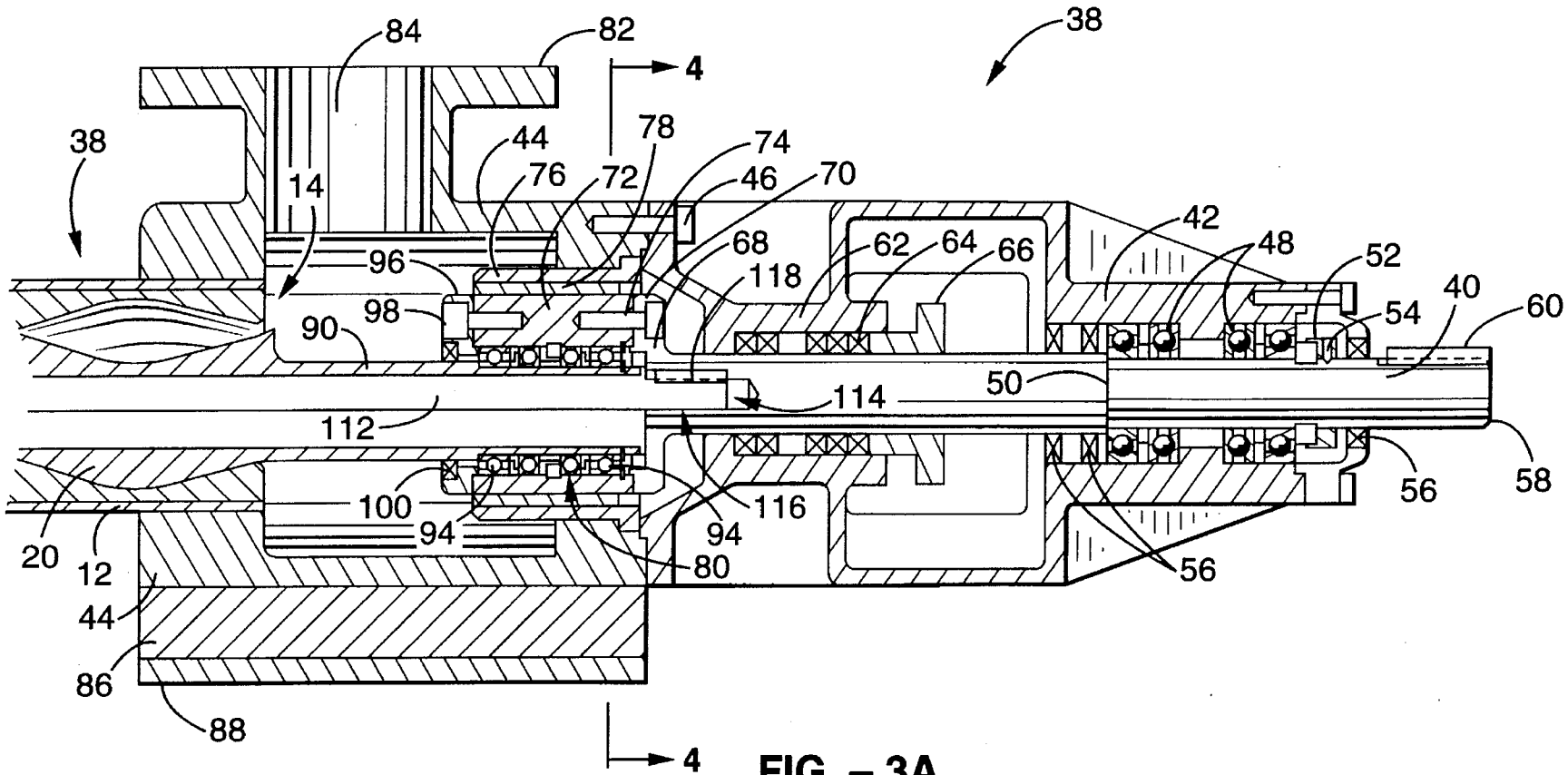
FIG. 3A and FIG. 3B show a longitudinal sectional view of a second embodiment of the present invention.
Figure 3B:
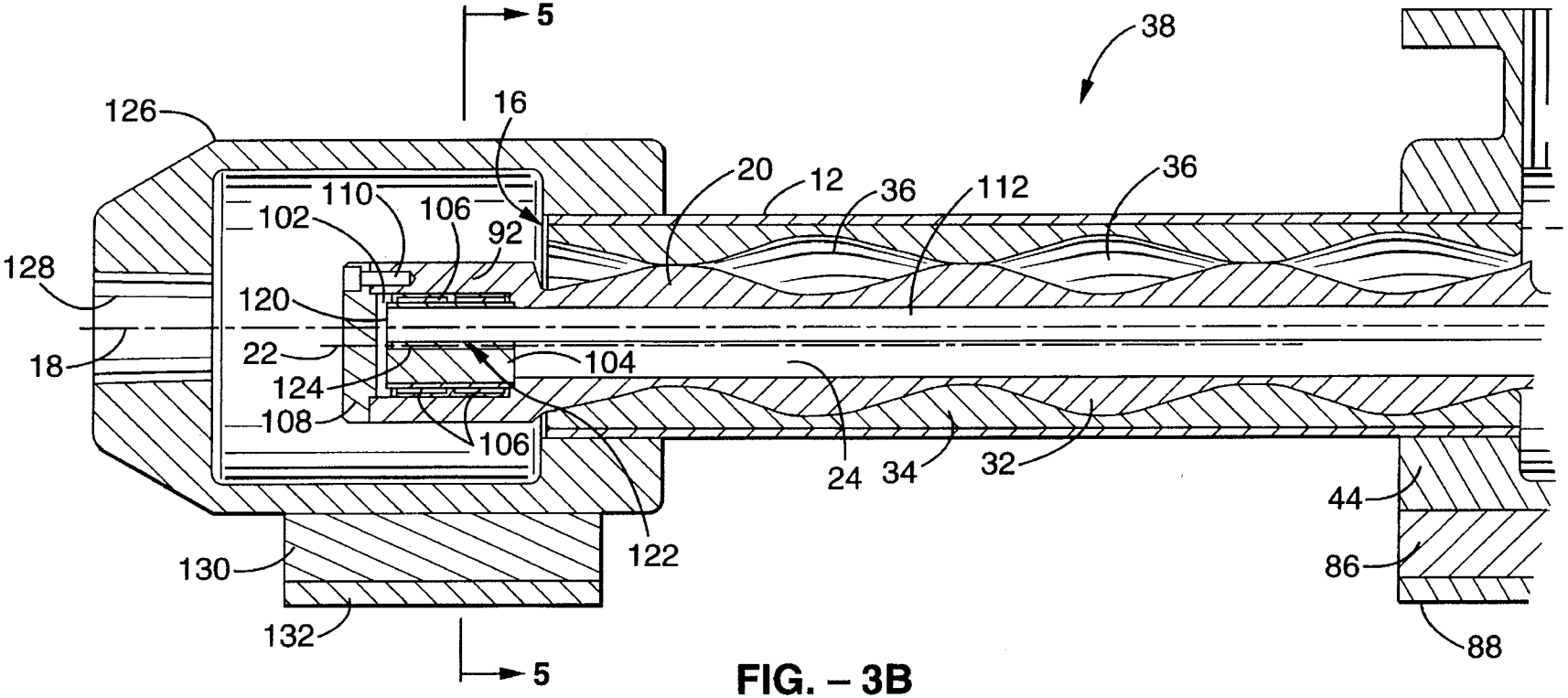

Inlet housing 44 has an inlet flange 82 adapted to allow connection to pipes, hoses, or other fluid sources. As related above, other fluid inlet means, such as pipe, tubing, and channel arrangements varying from those shown in FIG. 3A and 3B, are also contemplated. Inlet flange 82 opens to inlet channel 84, from which fluid can pass into stator 12 at stator first end 14. Preferably, inlet housing 44 also includes a mounting platform 86 having a mounting foot 88, so that the invention 38 can be secured to surfaces by mounting with screws, bolts, and the like.

Stator 12 contains a longitudinal rotor 20 having a centerline 22 that is eccentric relative to stator centerline 18 and drive shaft 40. Rotor 20 includes a hub 90 and a head 92. Rotor hub 90 is rotatably mounted within bore 80 in hub drive block 72. Friction reducing means, preferably in the form of a plurality of radial and thrust bearings 94, are included between hub drive block 72 and hub 90. Bearings 94 are held in place within drive block bore 80 by a bearing cover 96 fastened to hub drive block 72, preferably by bolts 98. Seals 100 in cover 96 protect bearings 94 from contamination and hold lubricants in.

Rotor head 92 contains an aperture 102 that is concentric relative to rotor centerline 22. Rotatably mounted within rotor head aperture 102 is a rotor head drive block 104. Means for reducing friction, preferably in the form of radial bearings 106, are included in aperture 102 between head drive block 104 and rotor head 92. A rotor head cover 108 contains rotor head drive block 104 in aperture 102 and is fastened to rotor head 92, preferably by bolts 110.

Rotor 20 contains a longitudinal bore 24 concentric with rotor centerline 22. The means for driving the rotor also includes a longitudinal shaft, shown here as an auxiliary drive shaft 112 positioned within longitudinal bore 20. Auxiliary drive shaft 112 is concentric with drive shaft 40 and rotates concentrically with stator centerline 18. Auxiliary drive shaft first end 114 engages a bore 116 in drive shaft 40, and is fixedly coupled to drive shaft 40, preferably by a key 118. Auxiliary drive shaft second end 120 engages rotor head drive block 104 within bore 120 and is fixedly coupled to head drive block 104 by a key 124, a spline, or the like. Bore 122 is eccentric relative to head drive block 104 and concentric with stator centerline 18.

Fluid outlet means, preferably in the form of a discharge housing 126, is included at stator second end 16. Discharge housing includes a discharge channel 128. Rotor head 92 extends out of stator 12 and into discharge housing 126. Preferably, discharge housing 126 also includes a mounting platform 130 having a mounting foot 132, for mounting to surfaces by screws, bolts, and the like. Fluid outlet means may also comprise an outlet flange, outlet hose, pipe, tubing, channel or like means.

Rotor 20 includes at least one helix or lobe 32, and stator 12 includes at least two helices 34. Preferably, rotor 20 will have n helices and stator will have n+1 helices, as described above in the first embodiment. The rotor and stator helices are structured and configured so that a plurality of cavities 36 are formed between rotor 20 and stator 12. Preferably, the rotor and stator helices have a generally hypocycloidal profile, although other helix profiles, such as involute, are also contemplated for use with the present invention.

Figure 4:
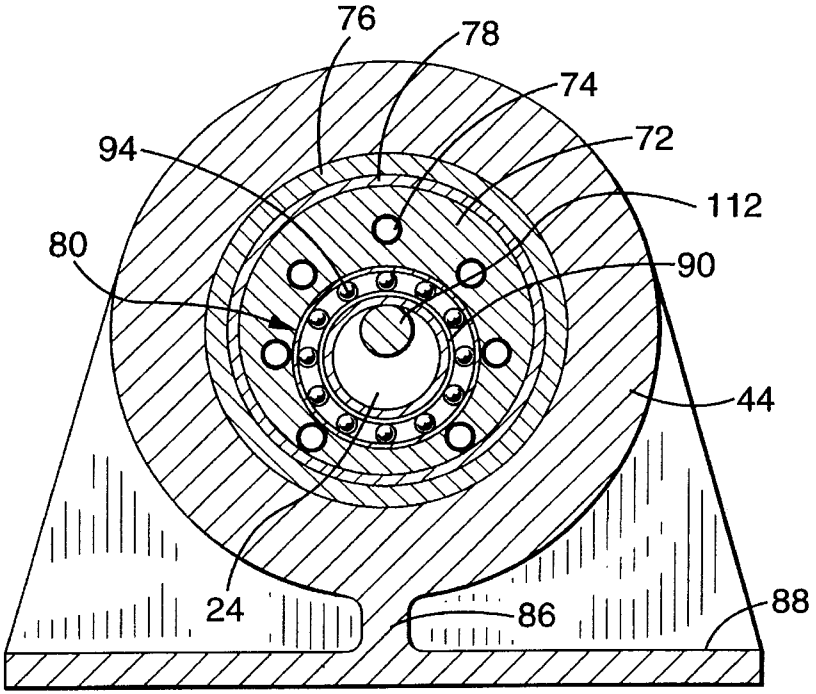
FIG. 4 is a cross-sectional view of the embodiment shown in FIG. 3A and FIG. 3B taken through line 4—4.
Figure 5:
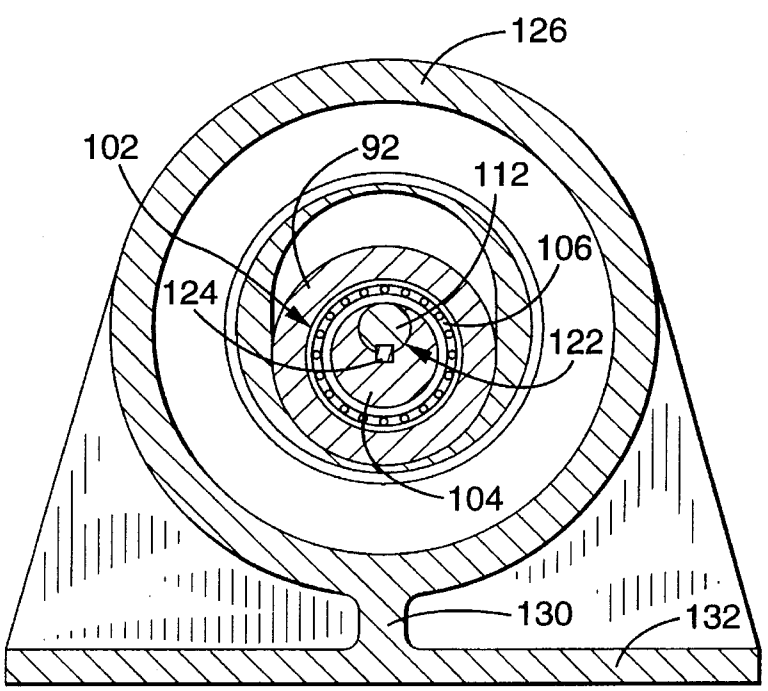
FIG. 5 is a cross-sectional view of the embodiment shown in FIG. 3A and FIG. 3B taken through line 5—5.

In operation, the embodiment of the present invention shown in FIG. 3A, FIG, 3B, FIG. 4, and FIG. 5 is driven by applying rotational actuation from an external power source to drive shaft 40, preferably through key 60. Drive shaft 40 in turn rotates hub drive block 72 within housing flange 76. Since hub drive block 72 has a bore 80 eccentric to drive shaft 40, drive block 72 acts as a crank and drives rotor hub 90 within bore 80, and thus drives rotor 20. The drive shaft 40 also imparts rotary motion to the auxiliary drive shaft 112 through key 118 at auxiliary shaft first end 114. The auxiliary drive shaft 112 then imparts rotary motion to rotor head drive block 104 through key 124 at auxiliary drive shaft second end 120. Rotor head drive block 104 then acts as a crank, driving rotor head 92 and thus rotor 20. The bearings included at each of the journal surfaces at rotor hub 90 and head 92 reduce friction and aid the rotary motion of rotor 20. Thus, both hub 90 and head 92 of rotor 20 are simultaneously acted on by the cranking effect of hub drive block 72 and head drive block 104 respectively, forcing the rotor 20 to rotate about its own centerline 22 and orbit about stator centerline 18. Rotor head 92, as a result of the rotating and orbiting motion of rotor 20, moves within discharge housing 126 in a nutating fashion. If rotor 20 rotates in a clockwise direction, then its orbital motion about stator centerline 18 is counterclockwise in motion, and vice versa.

The rotational and orbital motion of rotor 20 inside stator 12 causes the cavities 36 between rotor helices 32 and stator helices 34 to progressively move. When cavities 36 are filled with liquid from inlet channel 84, a pumping action is achieved. Inlet flange 82 can be connected to a pipe, hose, tank, or other fluid source. Discharge channel 128 can be connected with a pipe, hose, tank or other fluid receptacle. By reversing the rotational direction of drive shaft 40, the rotational and orbital directions of rotor 20, and thus the direction of fluid pumping can be reversed, going from discharge channel towards inlet channel. Alternatively, the position of the fluid inlet means and fluid outlet means could be reversed to change the pumping direction.

The embodiment shown in FIG. 3 through FIG. 5 is an adaptation of the arrangement shown in FIG. 1 and FIG. 2 wherein the driving means is arranged so that power is imparted to the rotor 20 only at the two points; the rotor hub 90 and rotor head 92. Thus, instead of having a journal surface extending along the entire length of eccentric shaft 26, as shown in FIG. 1 and FIG. 2, this embodiment has driving means with substantially smaller journal surfaces and correspondingly smaller frictionally related surfaces. This results in requiring bearings and lubrication only at rotor hub 90 and rotor head 92, rather than along the entire length of rotor 20. Further, in the embodiment shown in FIG. 3 through FIG. 5, the rotor 20 is supported along most of its length by the stator, and thus rotor head 92 can be capped with cap 108 helping to seal bearings 106 from fluid contamination at the head end of rotor 20. In contrast, the arrangement shown in FIG. 1 and FIG. 2 has eccentric shaft 24 with journal surfaces adjacent each end 14, 16 of stator 12, thus creating the possibility of fluid contamination of bearings at each end.

The driving means may alternatively comprise a bore directly situated in drive shaft 40, with rotor hub 90 rotatably mounted directly within the bore in the drive shaft. However, in the preferred embodiment shown here, rotor hub 90 is rotatably mounted within bore 80 in hub drive block 72.

Referring next to FIG. 6A, FIG. 6B, FIG. 7, and FIG. 8, there is shown a third embodiment 133 of the present invention, wherein like reference numerals denote like parts. In this embodiment, a drive block housing 134 is fixedly coupled to discharge housing 126 by support members 135 (FIG. 8) such that drive block housing 134 is concentric with stator 12. A head drive block 136 is rotatably mounted within drive block housing 134. Friction reducing means, such as a marine bearing 138, are included along the journal surface between drive block housing 134 and head drive block 136.

Head drive block 136 contains a first bore 140 which is concentric relative to rotor centerline 22 and eccentric relative to head drive block 136 and stator centerline 18. Rotor head 92 is rotatably mounted within first bore 140 in head drive block 136. Friction reducing means, preferably in the form of a marine bearing 142, is included between rotor head 92 and head drive block 136.

Head drive block 136 also contains a second bore 144, the second bore 144 being concentric with stator centerline 18 and head drive block 136, and eccentric relative to rotor head 92. Auxiliary shaft second end 120 engages second bore 144 and is fixedly coupled to head drive block 136 within bore 144, preferably by a key 146.

In operation, the embodiment of the invention depicted in FIG. 6A, FIG. 6B, FIG. 7, and FIG. 8 is driven by applying rotational actuation from an external power source to drive shaft 40, which in turn rotates hub drive block 72. Since drive block 72 has a bore 80 eccentric to drive shaft 40, hub drive block 72 acts as a crank and drives rotor hub 90 within bore 80 and thus the rotor 20. The drive shaft 40 also imparts rotary motion to the auxiliary drive shaft 112 through key 118 at auxiliary drive shaft first end 114. The auxiliary drive shaft 112 then imparts rotary motion to head drive block 136 through key 146 at auxiliary drive shaft second end 120. The second drive block 136 then acts as a crank, driving rotor head 92, and thus the rotor 20.

Figure 6A:
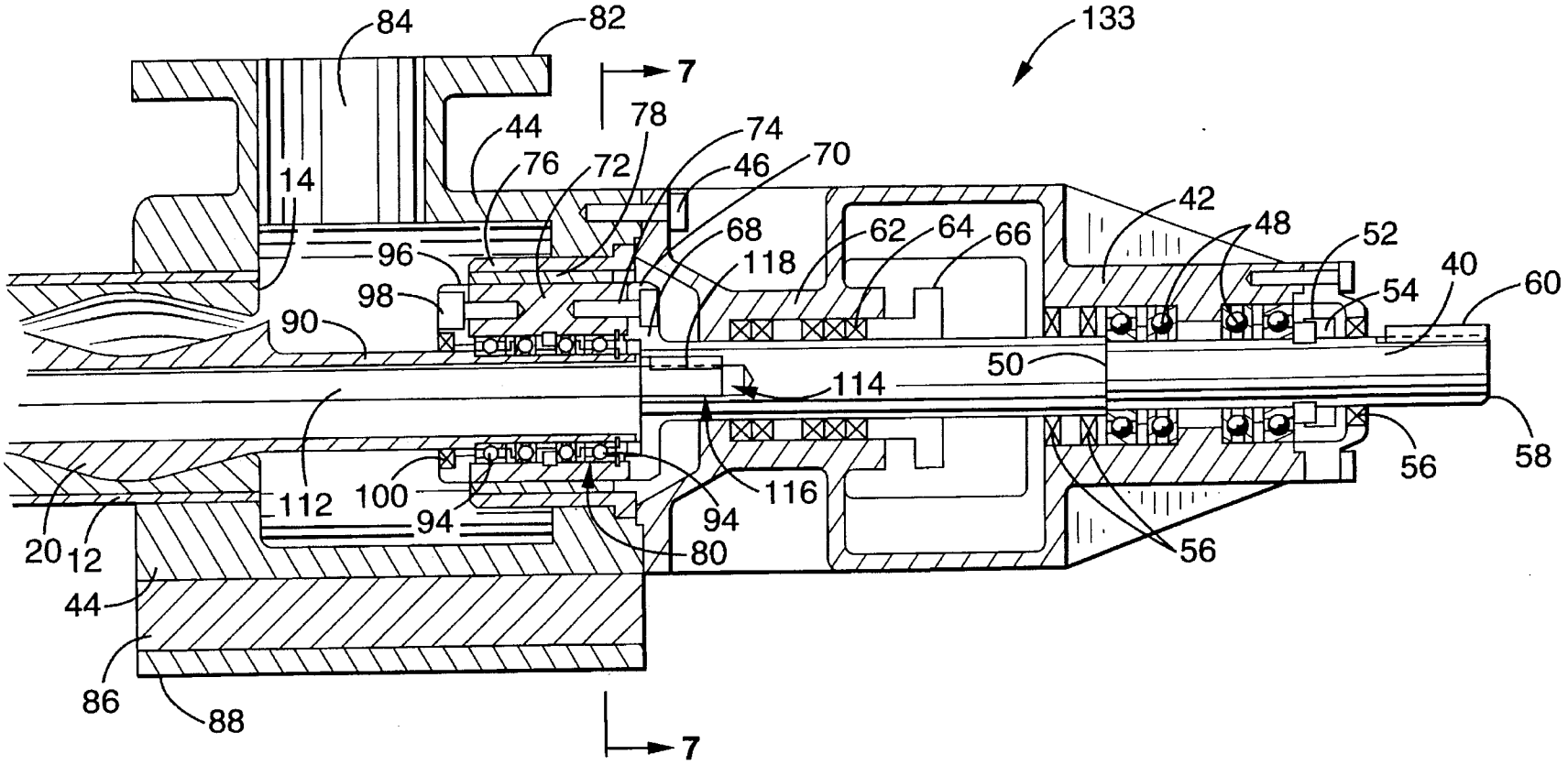
FIG. 6A and FIG. 6B show a longitudinal sectional view of a third embodiment of the present invention.
Figure 6B:
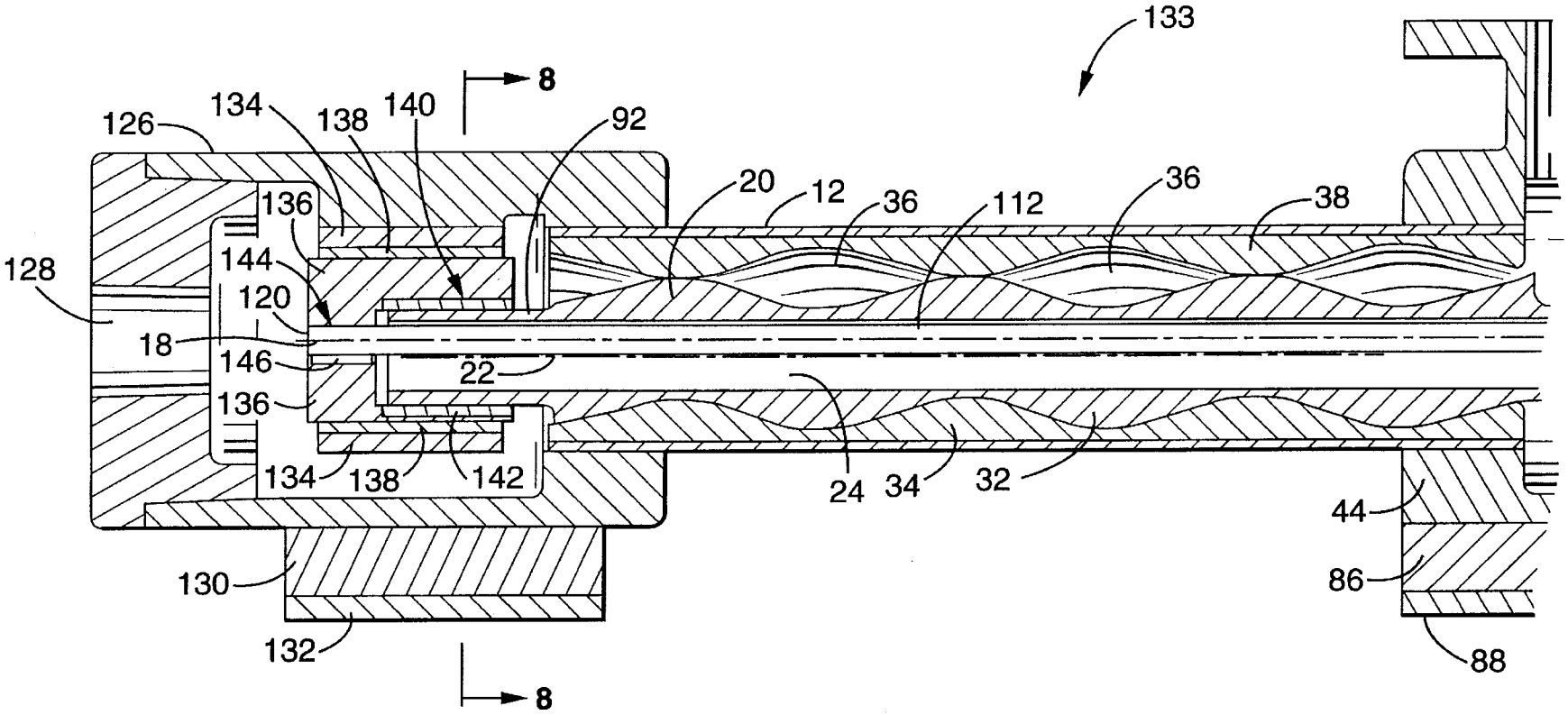
Figure 8:
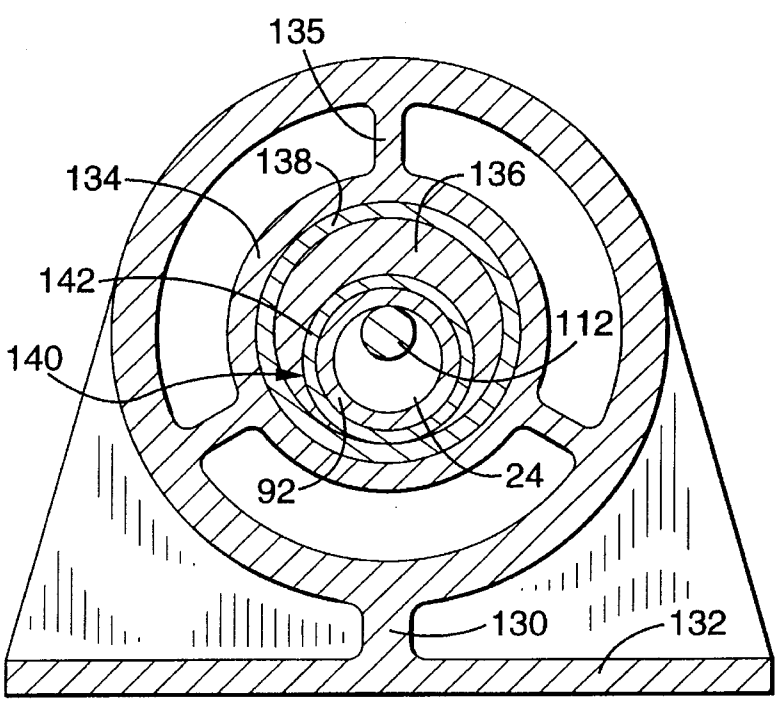
FIG. 8 is a cross-sectional view of the embodiment shown in FIG. 6A and FIG. 6B taken through line 8—8.
Figure 7:
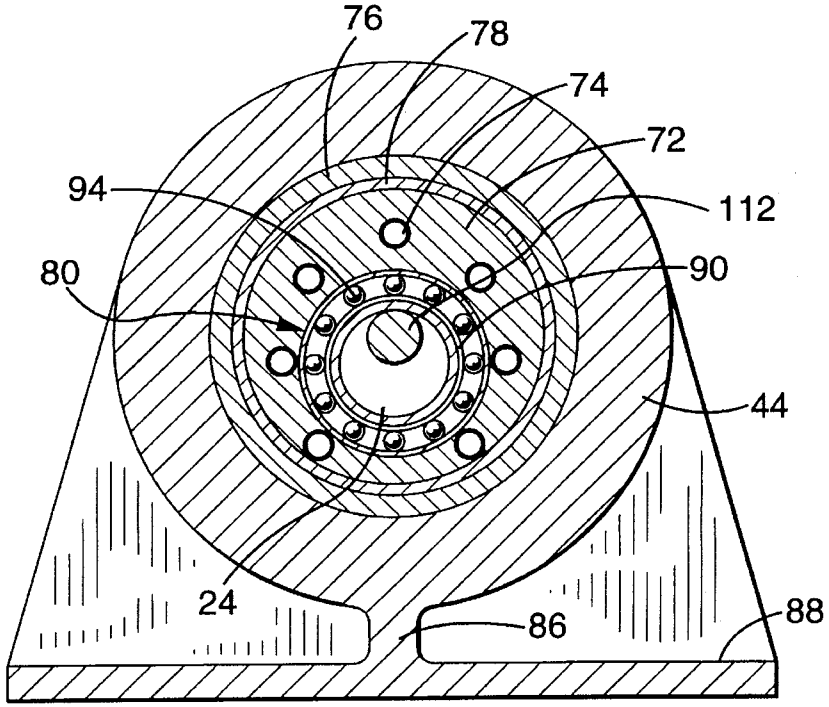
FIG. 7 is a cross-sectional view of the embodiment shown in FIG. 6A and FIG. 6B taken through line 7—7.
Figure 9A:
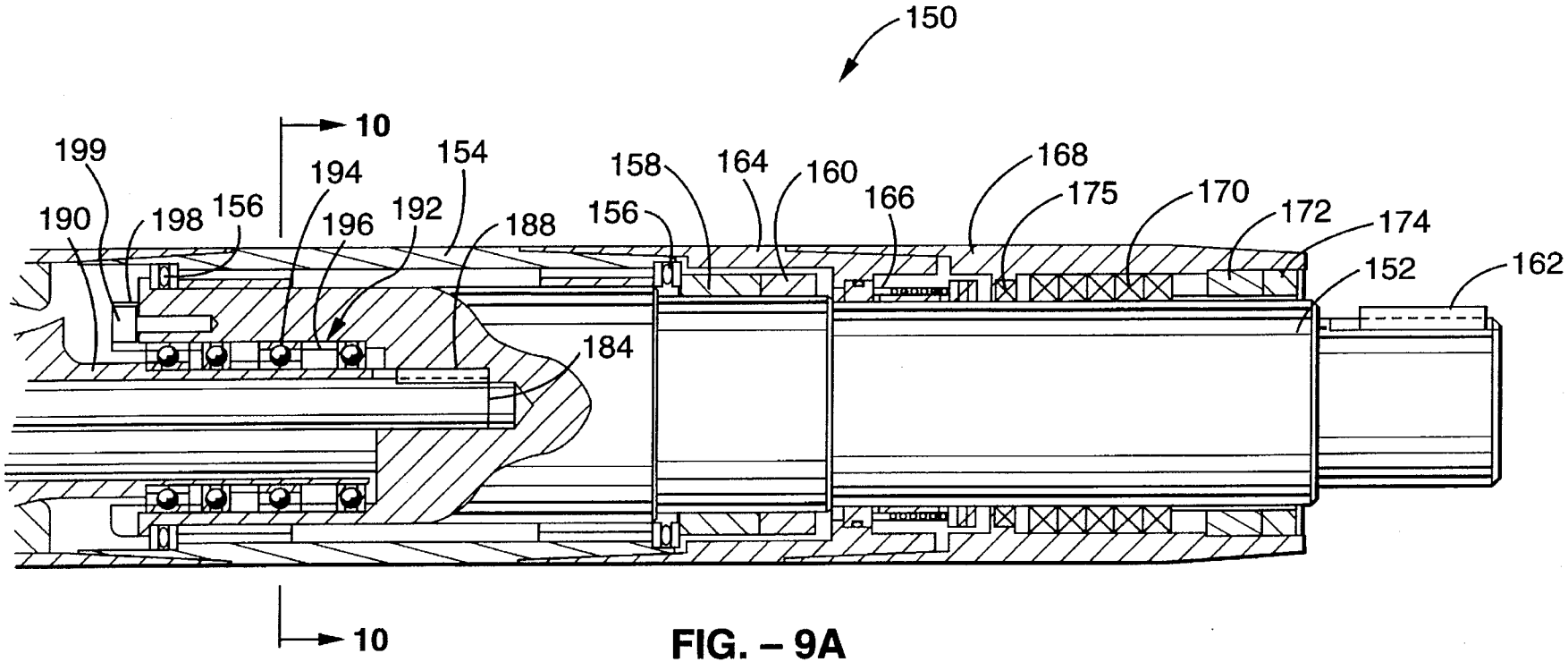
FIG. 9A through FIG. 9D show a longitudinal sectional view of the present invention being used as a rotational speed reducer for a progressing cavity pump.
Figure 9B:
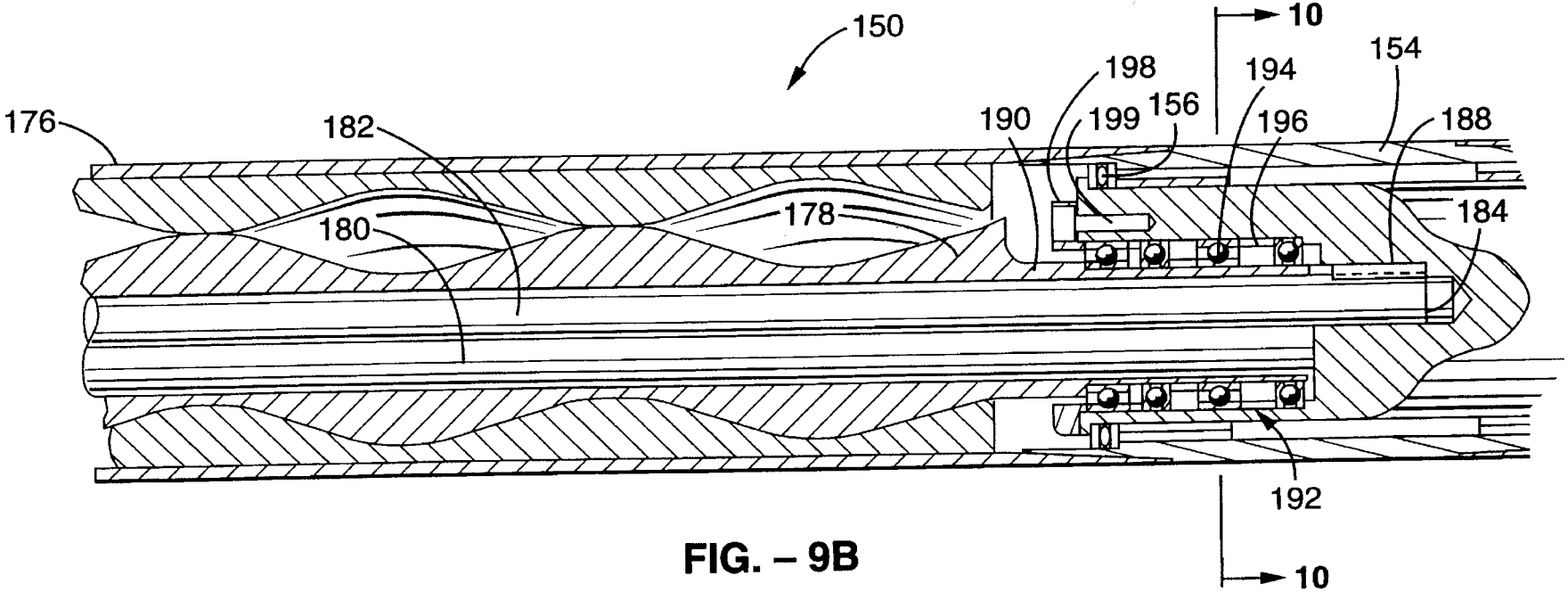
Figure 9C:
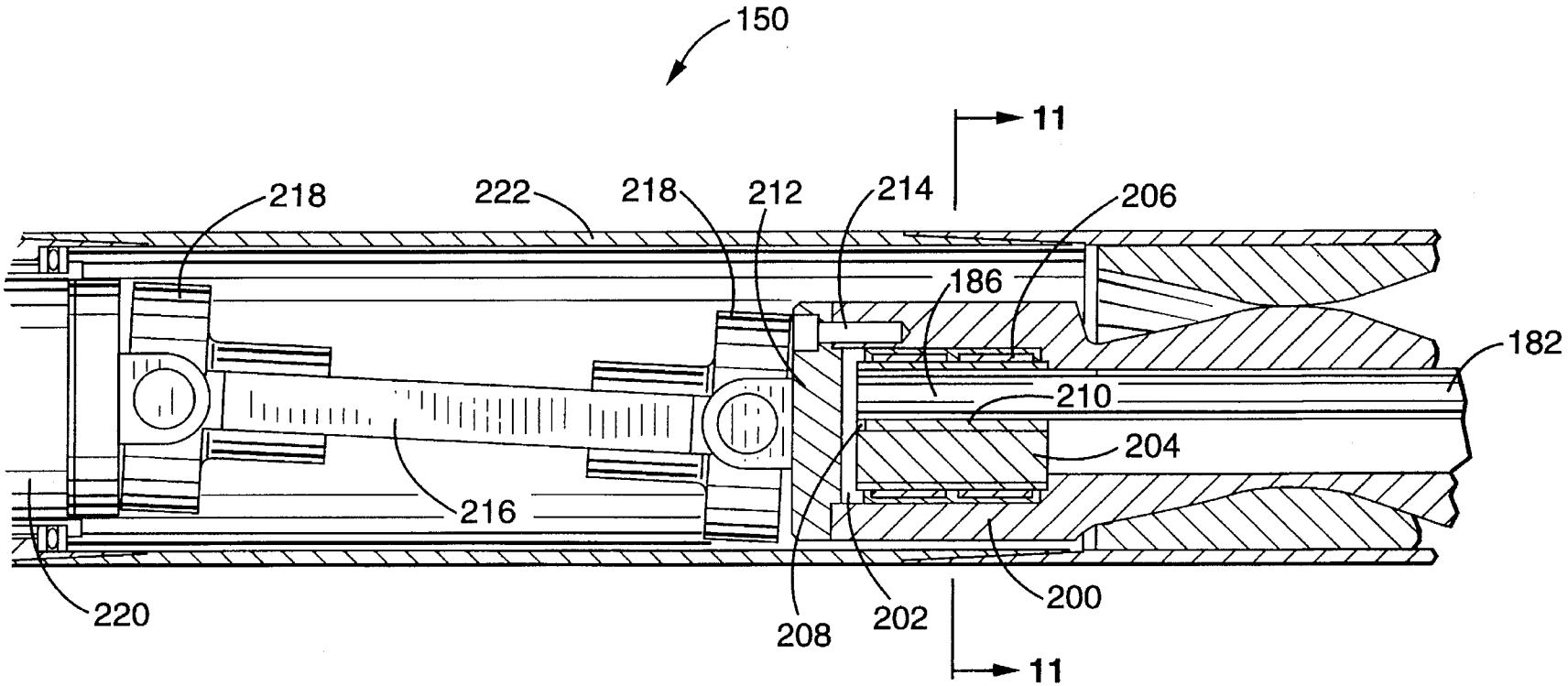
Figure 9D:
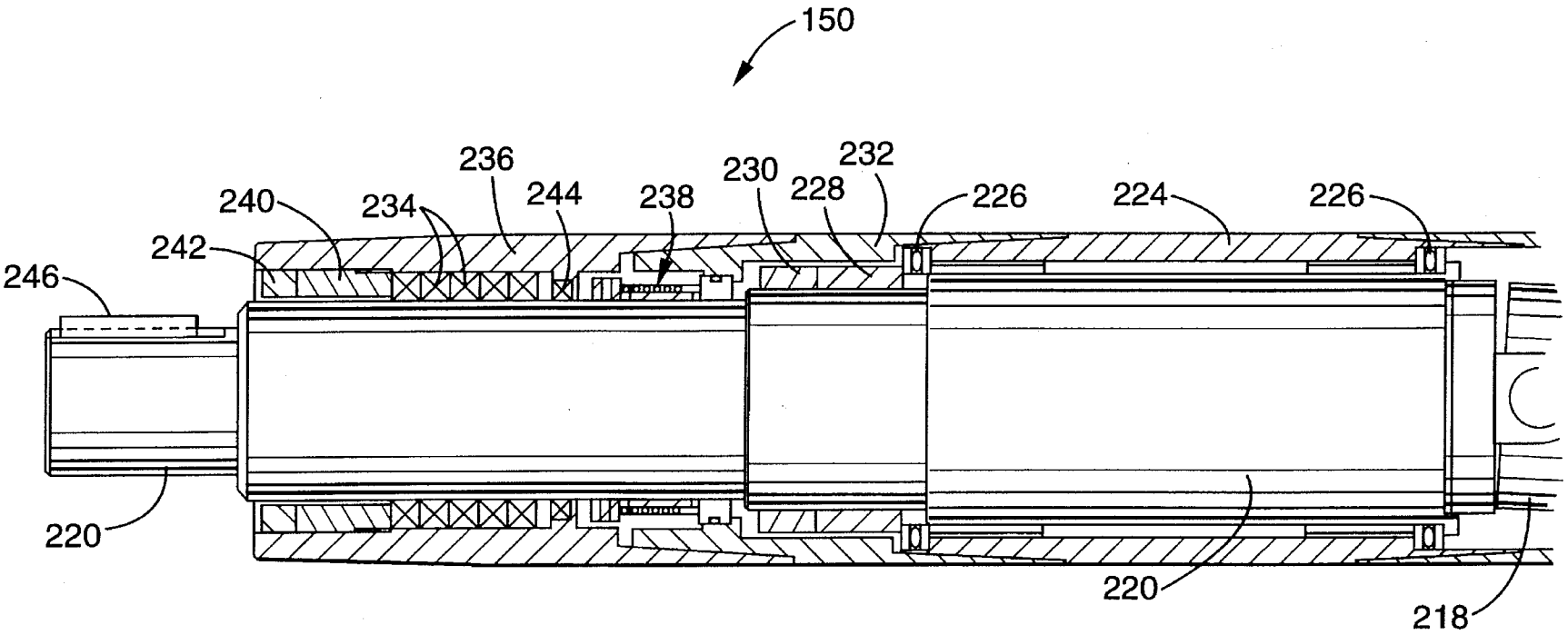

The primary difference between the second embodiment of the present invention shown in FIG. 3 through FIG. 5 and the third embodiment shown in FIG. 6 through FIG. 8 is within the means for driving the rotor, and particularly the location of the head drive block relative to the rotor head. In the second embodiment, head drive block 104 is rotatably mounted within a bore 102 in rotor head 92, while in the third embodiment the rotor head 92 is rotatably mounted within bore 140 in head drive block 136. However, in both the second and third embodiments, the head drive block acts as a crank to drive rotor head 92. Thus, in both the second and third embodiments, the driving means for the rotor involves delivery of rotational power to the rotor at the rotor hub and rotor head, since both rotor hub 90 and rotor head 92 are simultaneously acted on by equivalent cranks, forcing the rotor 20 to rotate about its own centerline 22 and orbit about stator centerline 18. If rotor 20 rotates in a clockwise direction, then its orbital motion about stator centerline 18 is counterclockwise in motion, and vice versa. The rotational and orbital motion of rotor 20 inside stator 12 cause the cavities 36 between rotor helices 32 and stator helices 34 to progressively move. When cavities 36 are filled with liquid from inlet channel 84, a pumping action is achieved.

As with the second embodiment, inlet flange 82 can be connected to a pipe, hose, tank, or other fluid source. Discharge outlet 128 can be connected with a pipe or other fluid receptacle. By reversing the rotational direction of drive shaft 40, the rotational and orbital directions of rotor 20, and thus the direction of fluid pumping can be reversed, going from discharge towards inlet. Alternatively, the positions of the fluid inlet and fluid outlet means could be reversed to change the pumping direction.

As can be seen in FIG. 6A and FIG. 6B, the head drive block 136 and rotor head 92 are mounted within drive block housing 134 which in turn is mounted to discharge housing 126. Thus, the rotor 20 in the third embodiment of the invention has more support than in the second embodiment, where, as FIG. 3B shows, the rotor is not affixed to the discharge housing 126, but instead nutates freely within discharge housing 126. This additional support to the rotor 20 in the third embodiment minimizes side loading on the rotor 20. However, the additional support to the rotor 20 provided in the third embodiment reduces the volume available in discharge outlet 128 and thus will result in slower pumping rates.

Figure 11:
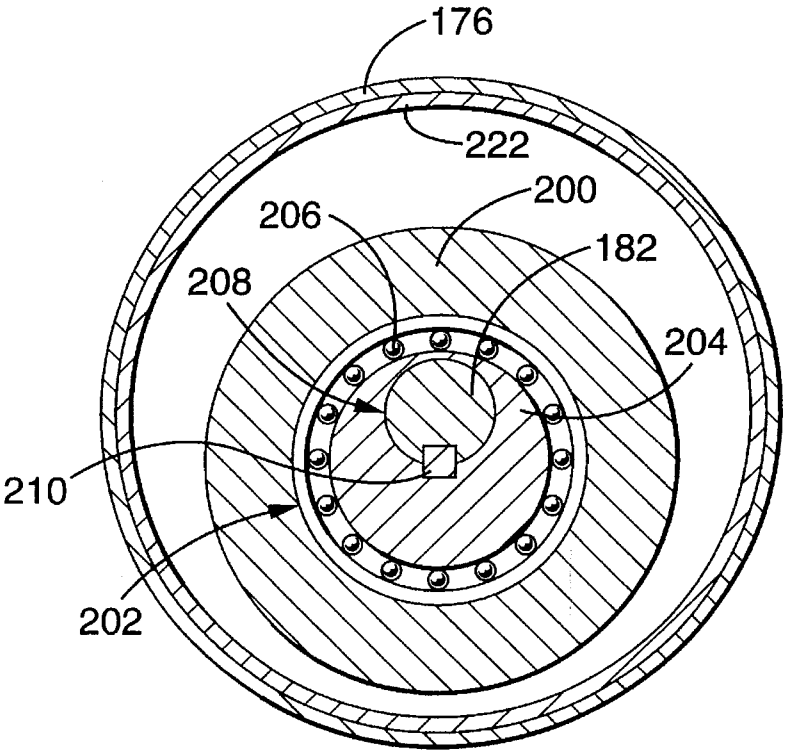
FIG. 11 is a cross-sectional view of the speed reducer shown in FIG. 9A through 9D. taken through line 11—11.
Figure 10:
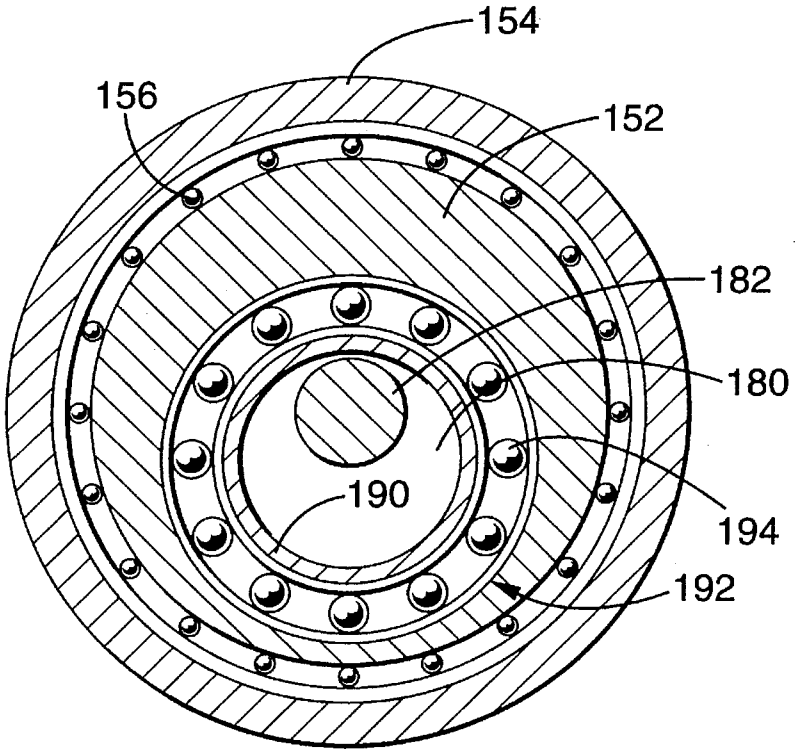
FIG. 10 is a cross-sectional view of the speed reducer shown in FIG. 9A through FIG. 9D taken through line 10—10.

Referring now to FIG. 9A through FIG. 9D as well as FIG. 10 and FIG. 11, the present invention is shown configured as a speed reducer 150 for a progressing cavity pump. The present invention works as a speed reducer with essentially the same mechanical arrangement as used for the pump embodiments shown in FIG. 1 through FIG. 8, with the primary difference being absence of fluid inlet and fluid outlet means, which are not required in the speed reducer embodiment. Additionally, the speed reducer embodiment of the present invention as shown in FIG. 9A through FIG. 9D as well as FIG. 10 and FIG. 11 does not require the sealing means typically present in pumps. Drive shaft 152 is mounted within a bearing housing 154 together with suitable friction reducing means, preferably in the form of a plurality of radial and thrust bearings 156. Drive shaft 152 is held in place by tightening down bearings 156 with bearing nut 158. Bearing nut 158 is attached to drive shaft 152 by suitable means such as threads (not shown). Bearing nut 158 is locked in place with lock nut 160. External rotational actuation means, such as an electric motor (not shown), is attached to drive shaft 152 by key 162.

Seal housing 164 is attached to bearing housing 154, preferably by threading (not shown). Mounted on drive shaft 152 and contained in seal housing 164 is a mechanical seal 166 which prevents debris and contaminants from reaching frictionally related surfaces.

Packing housing 168 attaches to seal housing 164, preferably by threading (not shown). Packing housing 168 includes a plurality of packings 170, which are held in compression within packing housing 168 by packing gland 172. Packing gland 172 engages packing housing 168 by threads (not shown). Packing gland 172 is locked into place by lock nut 174. High pressure lip seal 175 between packings 170 and mechanical seal 166 helps minimize entry of contaminants and debris.

A stator 176 engages bearing housing 154, preferably by threading (not shown). Stator 176 is concentric with shaft 152. Rotor 178 is included in stator 176, with rotor 178 being generally eccentric by a predetermined amount relative to stator and drive shaft. Rotor 178 includes a longitudinal bore 180 which is concentric with rotor 178 and eccentric relative to stator 176. An auxiliary drive shaft 182 having a first end 184 and second end 186 is accommodated within rotor bore 180. Auxiliary drive shaft 182 is eccentric relative to rotor 178 and concentric relative to drive shaft 152 and stator 176. Auxiliary drive shaft first end 184 is fixedly coupled to drive shaft 152 by key 188.

Rotor 178 includes a hub 190 which rotationally engages a bore 192 in drive shaft 152. Bore 192 is eccentric relative to drive shaft 152. Friction reducing means, preferably in the form of a plurality of radial and thrust bearings 194, are included along the journal surface shared by hub 190 and drive shaft bore 192. Spacer 196 separates radial and thrust bearings 194, with cover 198 holding radial and thrust bearings 194 in place. Cover 198 is coupled to drive shaft 152, preferably by bolts 199.

Rotor 178 also includes a head 200, with rotor head 200 containing a bore 202 concentric to rotor 178 and eccentric relative to stator 176. Rotationally mounted within bore 202 is a drive block 204. Friction reducing means, shown here as radial bearings 206, are included between rotor head bore 202 and drive block 204. Drive block 204 includes a bore 208 which is eccentric relative to drive block and concentric relative to stator 176 and drive shaft 152. Auxiliary drive shaft second end 186 is fixedly mounted in drive block bore 208, preferably by means of a key 210. Cap 212 covers bore 202 in rotor head 200 and protects bearings 206 from contamination. Bolt 214 or other suitable attachment means couples cap 212 onto rotor head 200.

Linking means, preferably in the form of linking drive shaft 216 with universal joints 218, connect rotor head 200 with pump drive shaft 220. Spacer housing 222 contains linking drive shaft 216 and universal joints 218. Spacer housing 222 couples with stator 176 and bearing housing 224, preferably by threads (not shown). Radial and thrust bearings 226 are included between bearing housing 224 and pump drive shaft 220, and are held in place by bearing nut 228 and lock nut 230. Packing housing 236 includes a plurality of packings 234 held in place by packing gland 240. Mechanical seal 238 in seal housing 232, together with high pressure lip seal 244, prevent contaminants from reaching frictionally related surfaces. Pump drive shaft 220 ultimately connects with a pump (not shown) by key 246.

The present invention in its speed reducer form operates with combined rotary and orbital motions in the manner described above for drive arrangements in the first, second, and third embodiments of the present invention. Since the invention generally has a ratio of rotor helices to stator helices of n/n+1, each clockwise rotation of an external drive source keyed to drive shaft 152 will result in rotor 178 making 1/n counterclockwise rotations within stator 176. Rotor 178, having undergone a rotational speed reduction of n:1 relative to the drive shaft 152, can in turn be used to drive pump drive shaft 220 and ultimately a progressing cavity pump at the lower speed. By varying the number of helices n, a variety of speed reduction ratios are possible. For example, employing a rotor with n=6 helices and an electric motor operating at 1800 rpm, a drive speed can be delivered by the present invention of 1800/6=300 rpm.

The speed reducer form of the present invention lends itself to a very compact circular cross section, which is ideally suited for submersible pumps which are driven by submersible electric motors operating at 1800 or 3600 rpm. These high rotation speeds require some form of speed reduction means before direct attachment to a pump. Conventionally, external gear trains are used for speed reduction, but the reduced space available in many submersible pump applications makes such gear train arrangements expensive.

The embodiments of the invention shown in FIG. 3 through FIG. 8 are depicted with preferred sealing means for operation as pump drive arrangements rather than as speed reducers. It should be readily apparent, however, that these embodiments of the present invention can also be used for speed reduction. Similarly, the embodiment of the invention shown in FIG. 9, FIG. 10, and FIG. 11 is depicted in an arrangement preferred for speed reduction, and could be used as a pump drive arrangement when provided with suitable sealing and bearing means such as marine bearings. The embodiment shown in FIG. 1 and FIG. 2 can also be used as a speed reducer, or, when provided with fluid inlet and outlet means and suitable sealing and bearing means, can be used as a pump drive arrangement. In situations where a progressing cavity pump has a low head requirement, the speed reducer itself can be used for fluid pumping provided that the bearings are adequately sealed and protected.

Accordingly, it will be seen that this invention provides a drive arrangement for progressing cavity pump which does not require universal joints or connecting rods, which is simple, compact, and reduced in size, which has frictionally related surfaces protected from fluid-born contaminants, and which can be used for rotational speed reduction means. Although the description above contains many specificities, these should not be construed as limiting the scope of the invention but as merely providing illustrations of some of the presently preferred embodiments of the invention. Thus the scope of this invention should be determined by the appended claims and their legal equivalents.

I claim:

1. A progressing cavity pump, comprising:

(a) a stator, said stator having a first end and a second end, said stator including at least two helices;

(b) a rotor, said rotor mounted within said stator, said rotor including a hub positioned adjacent to said first end of said stator, said rotor including a head, said head positioned adjacent to said second end of said stator, said rotor having a longitudinal bore, said rotor including at least one helix;

(c) driving means for driving said rotor associated with said longitudinal bore in said rotor, said driving means positioned adjacent said rotor hub, said driving means positioned adjacent to said rotor head;

(d) said driving means comprising a drive shaft, said drive shaft concentric relative to said stator, said drive shaft eccentric relative to said rotor;

(e) said driving means further comprising a hub drive block, said hub drive block fixedly coupled to said drive shaft, said hub drive block including a bore, said bore eccentric relative to said drive shaft and said hub drive block, said bore concentric with said rotor, said rotor hub rotatably mounted within said bore in said hub drive block;

(f) fluid inlet means for allowing fluid into said stator, said fluid inlet means positioned adjacent to said first end of said stator; and (g) fluid outlet means for allowing fluid to exit said stator, said fluid outlet means positioned adjacent to said second end of said stator.

2. A progressing cavity pump as recited in claim 1, further comprising an auxiliary drive shaft, said auxiliary drive shaft rotatably mounted in said longitudinal bore in said rotor, said auxiliary drive shaft including a first end and a second end, said auxiliary shaft concentric with said drive shaft and said stator, said auxiliary drive shaft eccentric relative to said rotor, said first end of said auxiliary shaft fixedly coupled to said drive shaft.

3. A progressing cavity pump as recited in claim 2, wherein said drive shaft is rotatably mounted within a housing, said housing positioned adjacent to said first end of said stator.

4. A progressing cavity pump as recited in claim 3, further comprising a head drive block, said head drive block fixedly coupled to said second end of said auxiliary shaft, said head drive block rotatably associated with said rotor head.

5. A progressing cavity pump as recited in claim 4, wherein said rotor head includes a bore, said bore eccentric relative to said stator, said bore concentric with said rotor, said head drive block rotatably mounted within said bore.

6. A progressing cavity pump as recited in claim 5, wherein said fluid outlet means includes a discharge housing, said discharge housing positioned adjacent to said second end of said stator.

7. A progressing cavity pump, comprising:

(a) a stator, said stator having a first end and a second end, said stator including at least two helices;

(b) a rotor, said rotor mounted within said stator, said rotor including a hub positioned adjacent to said first end of said stator, said rotor including a head, said head positioned adjacent to said second end of said stator, said rotor having a longitudinal bore, said rotor including at least one helix;

(c) a drive shaft, said drive shaft concentric relative to said stator, said drive shaft eccentric relative to said rotor;

(d) a hub drive block, said hub drive block fixedly coupled to said drive shaft, said hub drive block including a bore, said bore eccentric relative to said drive shaft and said hub drive block, said bore concentric with said rotor, said rotor hub rotatably mounted within said bore in said hub drive block;

(e) fluid inlet means for allowing fluid into said stator, said fluid inlet means positioned adjacent to said first end of said stator; and (f) fluid outlet means for allowing fluid to exit said stator, said fluid outlet means positioned adjacent to said second end of said stator.

8. A progressing cavity pump as recited in claim 7, further comprising an auxiliary drive shaft, said auxiliary drive shaft rotatably mounted in said longitudinal bore in said rotor, said auxiliary drive shaft including a first end and a second end, said auxiliary shaft concentric with said drive shaft and said stator, said auxiliary drive shaft eccentric relative to said rotor, said first end of said auxiliary shaft fixedly coupled to said drive shaft.

9. A progressing cavity pump as recited in claim 8, wherein said drive shaft is rotatably mounted within a housing, said housing adjacent said stator first end.

10. A progressing cavity pump as recited in claim 9, further comprising a head drive block, said head drive block fixedly coupled to said second end of said auxiliary shaft, said head drive block rotatably associated with said rotor head.

11. A progressing cavity pump as recited in claim 10, wherein said rotor head includes a bore, said bore eccentric relative to said stator, said bore concentric with said rotor, said head drive block rotatably mounted within said bore.

12. A progressing cavity pump as recited in claim 11, wherein said fluid outlet means includes a discharge housing, said discharge housing positioned adjacent to said second end of said stator.

13. A progressing cavity pump, comprising:

(a) a stator, said stator having a first end and a second end, said stator including at least two helices;

(b) a rotor, said rotor mounted within said stator, said rotor including a hub positioned adjacent said first end of said stator, said rotor including a head, said head adjacent said second end of said stator, said rotor having a longitudinal bore, said rotor including at least one helix;

(c) a drive shaft, said drive shaft concentric relative to said stator, said drive shaft eccentric relative to said rotor, said drive shaft rotatably mounted within a housing, said housing positioned adjacent to said stator first end;

(d) a hub drive block, said hub drive block fixedly coupled to said drive shaft, said hub drive block including a bore, said bore eccentric relative to said drive shaft and said hub drive block, said bore concentric with said rotor, said rotor hub rotatably mounted within said bore in said hub drive block;

(e) an auxiliary drive shaft, said auxiliary drive shaft rotatably mounted in said longitudinal bore in said rotor, said auxiliary drive shaft including a first end and a second end, said auxiliary shaft concentric with said drive shaft and said stator, said auxiliary drive shaft eccentric relative to said rotor, said first end of said auxiliary shaft fixedly coupled to said drive shaft;

(f) a head drive block, said head drive block fixedly coupled to said second end of said auxiliary shaft, said head drive block rotatably associated with said rotor head;

(g) said rotor head including a bore, said bore eccentric relative to said stator, said bore concentric with said rotor, said head drive block rotatably mounted within said bore;

(h) fluid inlet means for allowing fluid into said stator, said fluid inlet means positioned adjacent to said first end of said stator; and (i) fluid outlet means for allowing fluid to exit said stator, said fluid outlet means positioned adjacent to said second end of said stator, said fluid outlet means including a discharge housing, said discharge housing positioned adjacent said second end of said stator.

* * * * *